US005373610A

United States Patent [19]

Jean et al.

[11] Patent Number: 5,373,610

[45] Date of Patent: Dec. 20, 1994

[54] NONWOVEN LAPPED PRODUCT HAVING STRENGTH AND EDGES, PROCESS AND APPARATUS FOR MAKING SAME

[75] Inventors: Robert Jean, Fouqueville; Bernard Chatelet; Bernard Jourde, both of Elbeuf, all of France

[73] Assignee: Asselin, Elbeuf, France

[21] Appl. No.: 39,372

[22] PCT Filed: Aug. 26, 1992

[86] PCT No.: PCT/FR92/00823

§ 371 Date: Apr. 20, 1993

§ 102(e) Date: Apr. 20, 1993

[87] PCT Pub. No.: WO93/05215

PCT Pub. Date: Mar. 18, 1993

[30] Foreign Application Priority Data

Aug. 28, 1991 [FR] France ..... 91 10674

[51] Int. Cl.[5] ..... D01G 15/44; D01G 25/00

[52] U.S. Cl. ..... 19/163; 270/30; 270/31

[58] Field of Search ..... 19/161.1, 163; 270/30, 270/31, 35; 493/410, 419, 420, 421, 422, 423

[56] References Cited

U.S. PATENT DOCUMENTS

| | | | |
|---|---|---|---|
| 3,877,628 | 4/1975 | Asselin et al. | 270/30 X |
| 4,308,640 | 1/1982 | Bulla et al. | 19/163 |
| 4,766,649 | 8/1988 | Rudt et al. | 19/163 X |
| 4,830,351 | 5/1989 | Stanislaw | 270/31 |
| 4,944,502 | 7/1990 | Platzer et al. | 270/31 |

FOREIGN PATENT DOCUMENTS

| | | |
|---|---|---|
| 0315930 | 5/1989 | European Pat. Off. . |
| 0398240 | 11/1990 | European Pat. Off. . |
| 2388914 | 11/1978 | France . |
| 2553102 | 4/1985 | France . |
| WO91/15618 | 10/1991 | WIPO . |

*Primary Examiner*—Clifford D. Crowder
*Assistant Examiner*—John J. Calvert
*Attorney, Agent, or Firm*—Young & Thompson

[57] ABSTRACT

An unwinding carriage (14) is fed with a fiber web (4). This unwinding carriage (14) is displaced in a to-and-fro movement, causing it to deposit the web (4) on an exit conveyor (8) driven transversely to the movement of the unwinding carriage (14), so as to produce a lap (6) consisting of successive breadths of web inclined alternately in relation to the longitudinal direction of the exit conveyor (8), these breadths being joined by means of folds defining the edges of the lap produced (6). The advance of the exit conveyor (8) at the moments of the changes in direction of the unwinding carriage (14) is maintained. During these changes in direction, the unwound quantity of web (4) is restricted so as to exert on the fibers, between the exit conveyor (8) and the unwinding carriage (14), a pull tending to orient the fibers which form the folds of the web in the lap (6) parallel to the longitudinal direction of the exit conveyor (8). The invention is used particularly for making needled products.

10 Claims, 5 Drawing Sheets

NONWOVEN LAPPED PRODUCT HAVING STRENGTH AND EDGES, PROCESS AND APPARATUS FOR MAKING SAME

FIELD OF THE INVENTION

The present invention relates to a lapping process for producing a nonwoven lap.

The present invention also relates to a nonwoven lapped product which can be obtained by means of the process.

The present invention relates, furthermore, to a stretcher/lapper for carrying out the process and for obtaining the product.

BACKGROUND OF THE INVENTION

Conventional stretcher/lappers are known, for example from DE-B-1,927,863, and in these an unwinding carriage executes transverse to-and-fro movements above an exit conveyor movable at a constant speed.

When the unwinding carriage is at either one of its ends of travel, it has to stop in order to change its direction of movement, while it continues to unwind the web onto the exit conveyor at an unchanged speed. However, since the relative speed between the carriage and the exit conveyor has decreased greatly since it no longer comprises the transverse component of the movement of the unwinding carriage, the web is unwound in excess. These traditional machines thus produce considerable lateral bolsters which subsequently have to be eliminated in order to obtain a product having per unit area a weight which is approximately uniform at all points of its width.

It is known from FR-B-2,234,395 to overcome these disadvantages, on the one hand, by imparting to the exit conveyor a speed which varies in proportion to the absolute value of the speed of the unwinding carriage, particularly in such a way that the exit conveyor is at a stop when the unwinding carriage is itself at a stop during its changes of direction of movement, and on the other hand by giving the feed carriage located upstream of the unwinding carriage a law of movement such that the unwinding carriage delivers the web at a speed which is itself proportional to the speed of the exit conveyor and to the absolute value of the speed of the unwinding carriage.

Thus, the quantity of web deposited per unit area of the exit conveyor is theoretically constant, and consequently the lapped product produced is theoretically perfectly uniform.

Moreover, as a result of the lapping operation, the initially longitudinal fibers of the web feeding the stretcher/lapper are arranged transversely in the lap at a particular angle of inclination, for example less than 15°. A result of this is that the tensile strength of the lap is much lower in the longitudinal direction of the lap than in its transverse direction which virtually coincides with the orientation of the fibers. This is a disadvantage because the lap is an intermediate product intended to undergo subsequent conversions, especially by needling, in the course of which it is pulled in its longitudinal direction. It is therefore in the longitudinal direction that the highest tensile strength would be desired. The poor tensile strength which has to be allowed for at the present time in order to conduct the needling or such like operations limits the working speed and brings about a transverse shrinkage during the needling, this shrinking tending to generate overthicknesses at the edges.

OBJECT OF THE INVENTION

The object of the present invention is to provide a lapping process, a lapped product and a stretcher/lapper which overcome these disadvantages and which make it possible, in particular, to produce in a very simple way a lapped product having a high longitudinal tensile strength.

SUMMARY OF THE INVENTION

According to the invention, the lapping process, in which an unwinding carriage is fed with a web comprising fibers directed substantially parallel to the length of this web, whilst this unwinding carriage is displaced in a to-and-fro movement above an exit conveyor, causing it to deposit the web on the exit conveyor driven in a direction which is transverse to the direction of movement of the unwinding carriage, so as to produce a lap consisting of successive breadths inclined once in one direction and once in the other in relation to the longitudinal direction of the exit conveyor, these breadths being joined by means of folds defining the edges of the lap produced, a process in which the advance of the exit conveyor at the moment of the change in direction of the movement of the unwinding carriage is maintained, is defined in that, at said moment, the quantity of web unwound by the unwinding carriage toward the exit conveyor is restricted so as to exert on the fibers, between the exit conveyor and the unwinding carriage, a pull tending to orient the fibers which form the folds of the web in the lap parallel to the longitudinal direction of the exit conveyor.

A kind of cord consisting largely of longitudinally oriented fibers is thus formed along the two longitudinal edges of the lap. These cords thus have a surprising tensile strength and for the subsequent processing, especially during needling, constitute a kind of tensile reinforcement which considerably reinforces the lap in respect of the deformations which tend to occur under the effect of the pull.

It is possible subsequently, for example after the needling operation, to eliminate the two lateral cords, of which the thickness, apparent density and structure do not conform to those of the rest of the lap.

Although this produces waste, nevertheless, surprisingly, this waste, accepted in principle in the process according to the invention, ultimately proves to be markedly less copious than that caused by many other processes which theoretically ought to produce no waste. The lateral strip to be cut off on each side of the lap can, for example, have a width of 50 mm according to the invention, instead of 150 mm in some known processes.

Furthermore, the invention makes it possible to minimize the transverse shrinkage during the needling, and consequently the needled product obtained has a better uniformity of weight.

According to a second subject of the invention, the nonwoven lapped product is defined in that it comprises, in its lateral edges, portions of fibers directed longitudinally and forming an obtuse angle with other portions of the same fibers directed obliquely toward the central part of the product.

According to a third subject of the invention, the stretcher/lapper, comprising transport means for defining a transport path of a web as far as an unwinding carriage movable in a to-and-fro movement above an exit conveyor movable transversely to the direction of the to-and-fro movement of the unwinding carriage, is defined by means for imparting to the exit conveyor a speed substantially proportional to the absolute value of the speed of the unwinding carriage, except within time intervals including the moments of change in direction of movement of the unwinding carriage, during which the speed of the exit conveyor is higher than that which would result from the calculation of proportionality in relation to the absolute value of the speed of the unwinding carriage, and by means for causing the web to be unwound by the unwinding carriage at a speed which is proportional to the speed of the exit conveyor, except within time intervals including the moments of change in direction of movement of the unwinding carriage, during which the unwinding speed is lower than that which would result from the calculation of proportionality in relation to the speed of the exit conveyor.

Other particular features and advantages of the invention will further emerge from the following description referring to a non-limiting example.

DETAILED DESCRIPTION OF THE INVENTION

Figure 1:
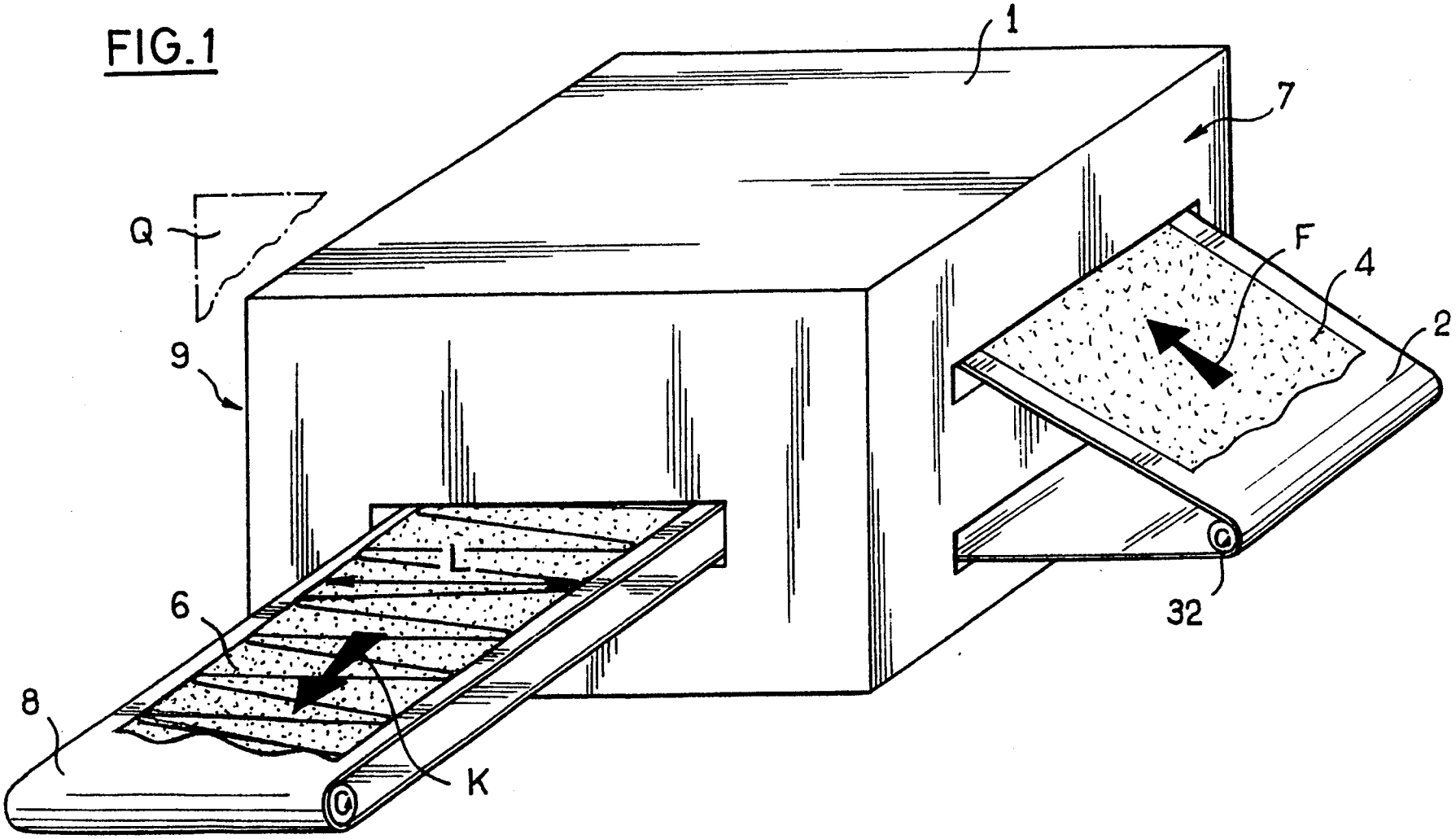
FIG. 1 is a perspective external view of a stretcher/-lapper.

A stretcher/lapper is shown in perspective in FIG. 1.

A first transporter conveyor 2, called a front transporter, takes up the fibre web 4, for example coming from a card (not shown), and transports it into the enclosure 1 of the stretcher/lapper, where it is converted by folding into a lap 6 of width L transported out of the stretcher/lapper by an exit conveyor 8. The web 4 consists of fibers essentially directed parallel to its length. The exit conveyor 8 can transport the formed lap 6 to a needler (not shown). The direction of transport of the web 4 and of the lap 6 are indicated in FIG. 1 by the respective arrows F and K. For reference purposes, the side 7 adjacent to the face by which the web 4 enters will be called the "front side" of the stretcher/lapper and the side 9 opposite the front side 7 the "rear side" of the stretcher/lapper.

Figure 2:
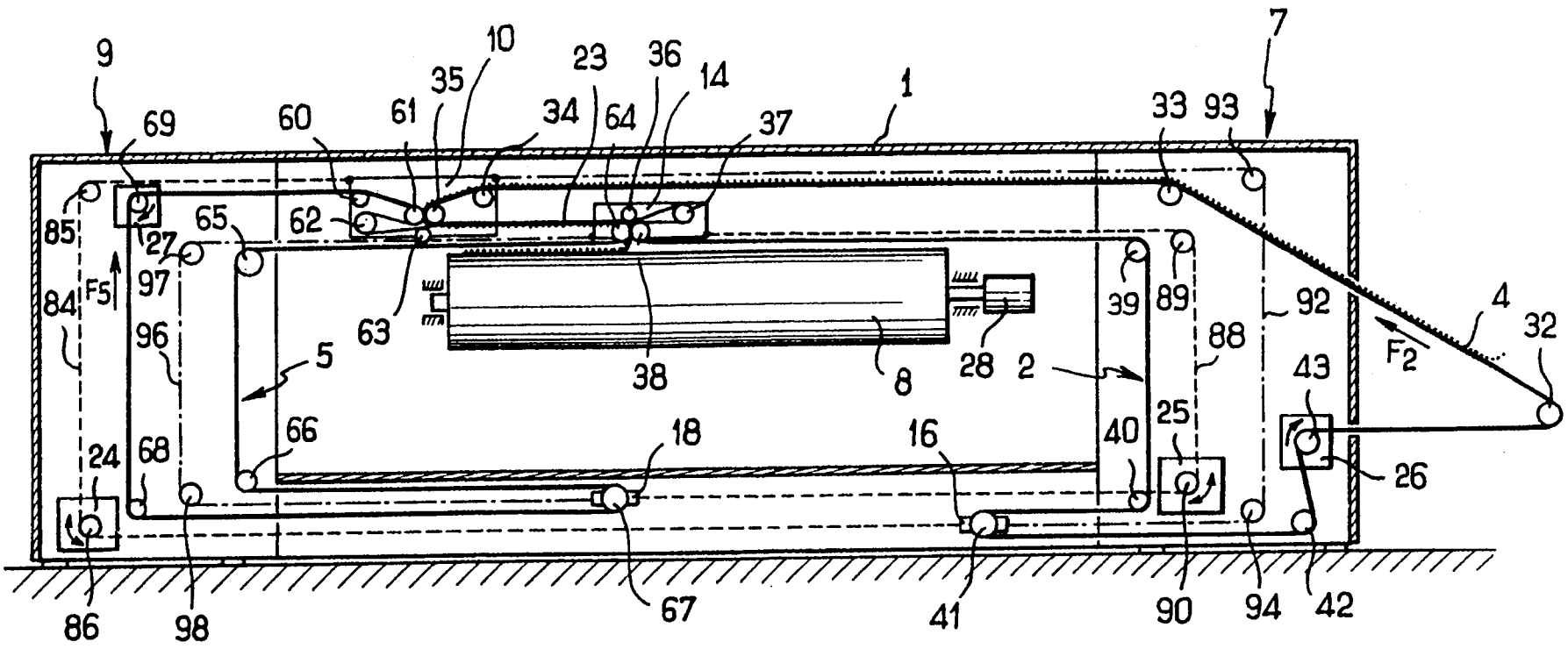
FIG. 2 is a diagrammatic elevation view of an example of a stretcher/lapper according to the invention.

The interior of the stretcher/lapper is shown diagrammatically in the elevation view of FIG. 2, taken in a plane Q (see FIG. 1) perpendicular to the direction of transport of the lap 6 out of the stretcher/lapper by the exit conveyor 8.

In addition to the front transporter 2, the stretcher/-lapper comprises a second transporter conveyor 5, called a rear transporter. The transporters 2 and 5, represented by unbroken lines in FIG. 2, have the same width and have their lateral edges in the same planes parallel to the plane Q of FIG. 2. The front transporter 2 follows a closed path defined by cylindrical guide rollers 32 to 43. The rear transporter 5 follows a closed path defined by cylindrical guide rollers 60 to 69.

The guide rollers 32 to 43 and 60 to 69 are mounted pivotably about respective axes which are all horizontal and perpendicular to the plane Q of FIG. 2, that is to say substantially parallel to the direction of movement of the exit conveyor 8. These guide rollers 32 to 43 and 60 to 69 comprise rollers 32, 33, 39, 40, 42, 43 and 65, 66, 68, 69, the axis of which is stationary in relation to the frame 1 of the stretcher/lapper, rollers 34, 35 and 60, 61, 62, 63 carried by a first movable main carriage 10, called a feed carriage, rollers 36, 37, 38 and 64 carried by a second movable main carriage 14, called an unwinding carriage, and rollers 41 and 67 carried by auxiliary carriages 16, 18. The auxiliary carriages 16, 18 each carry a guide roller 41, 67 corresponding to one of the transporters 2, 5. The two auxiliary carriages 16, 18 have movements which compensate those of the main carriages 10, 14 in order to keep constant the length of each of the closed paths followed by the transporters 2, 5. Between the main carriages 10, 14 and the auxiliary carriages 16, 18, the transporters 2, 5 are guided by rollers of stationary axis located on the sides 7, 9 of the stretcher/lapper on either side of the exit conveyor 8.

The main carriages 10, 14 are located above the exit conveyor 8 and are movable in translation in a horizontal direction perpendicular to the axes of the rollers 32 to 43 and 60 to 69.

During operation, the main carriages 10, 14 are displaced in this direction in a to-and-fro movement.

A first notched belt 84, represented by dashes in FIG. 2, has its ends fastened to the feed carriage 10 and to the first auxiliary carriage 16. The notched belt 84 is guided between these two carriages 10, 16 by pinions 85, 86 located on the rear side 9 of the stretcher/lapper. Moreover, these two carriages 10, 16 are coupled by means of a cable 92, represented by dot-and-dashed lines in FIG. 2, passing through the front side 7 of the stretcher/lapper and guided by pulleys 93, 94. The pinion 86 meshing with the notched belt 84 is driven by a motor 24. When the motor 24 drives the pinion 86 in a first direction, the feed carriage is drawn toward the rear side 9 of the stretcher/lapper, with the result that, by means of the cable 92, the associated auxiliary carriage 16 is drawn at the same speed toward the front side 7 of the stretcher/-lapper. When the motor 24 drives the pinion 86 in the other direction, the auxiliary carriage 16 is drawn toward the rear side 9 of the stretcher/lapper, with the result that, by means of the cable 92, the feed carriage 10 is drawn at the same speed toward the front side 7 of the stretcher/lapper.

A similar assembly is provided for driving the unwinding carriage 14 and its associated auxiliary carriage 18. A second notched belt 88, represented by dashes in FIG. 2, has its ends fastened to the unwinding carriage 14 and to the auxiliary carriage 18. The notched belt 88 passes through the front side 7 of the stretcher/lapper, going round two pinions 89, 90. Moreover, these two carriages 14, 18 are coupled by means of a second cable 96, represented by dot-and-dashed lines in FIG. 2, passing through the rear side 9 of the stretcher/lapper and guided by two pulleys 97, 98. The pinion 90 meshing with the notched belt 88 is driven in rotation by a motor 25. When the motor 25 drives the pinion 90 in a first direction, the unwinding carriage 14 is drawn toward the front side 7 of the stretcher/lapper, with the result that, by means of the cable 96, the associated auxiliary carriage 18 is drawn at the same speed toward the rear side 9 of the stretcher/lapper. When the motor 25 drives the pinion 90 in the other direction, the auxiliary carriage 18 is drawn toward the front side 7 of the stretcher/lapper, with the result that, by means of the cable 96, the unwinding carriage 14 is drawn at the same speed toward the rear side 9 of the stretcher/lapper.

The travel of the front transporter 2 along its closed path is provided by a motor 26 which drives one of the guide rollers 43 of the front transporter 2 in rotation. Likewise, the travel of the rear transporter 5 along its closed path is provided by a motor 27 which drives one of the guide rollers 65 passed round by the rear transporter 5 in rotation.

Figure 3:
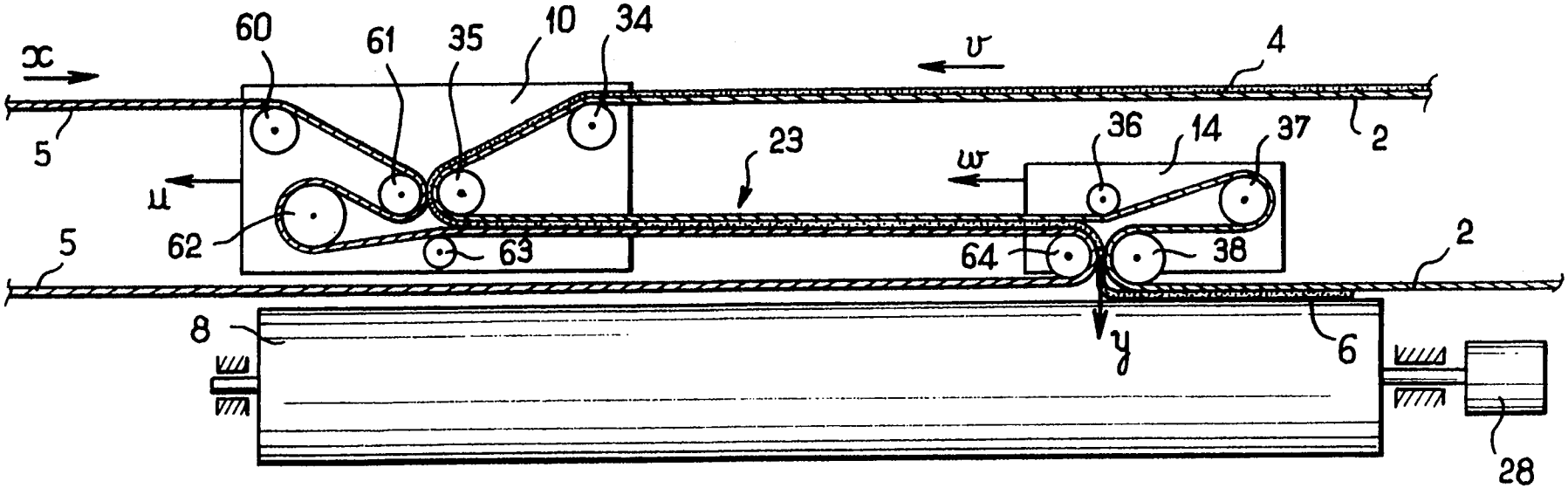
FIG. 3 is an enlarged view of part of the view of FIG. 2.

As can be seen in FIG. 2 and in the more detailed view in FIG. 3, the web 4 is delivered to the feed carriage 10 by the front transporter 2. On the feed carriage 10, the web 4 executes a 180° turn in order to enter a nip zone 23, in which it is held between the two transporters 2, 5. The nip zone 23 terminates at the unwinding carriage 14 which deposits the web 4 on the exit conveyor 8.

The to-and-fro movement of amplitude L of the unwinding carriage 14 ensures that the web 4 is deposited on the exit conveyor 8 in alternate folds, so as to form a lap 6 consisting of successive breadths of web. Since the exit conveyor 8 driven by a motor 28 is displaced perpendicularly to the direction of movement of the unwinding carriage 14, the successive breadths of web are inclined once in one direction and once in the other in relation to the longitudinal direction of the exit conveyor 8. The alternate folds which join the breadths to one another are therefore offset relative to the longitudinal direction of the lap 6 and define its lateral edges (see FIG. 5).

The kinematic laws applied by the various motive means of the stretcher/lapper, namely the drive motor 24 of the feed carriage 10, the drive motor 25 of the unwinding carriage 14, the motor 26 for the travel of the front transporter 2, the motor 27 for the travel of the rear transporter 5 and the drive motor 28 of the exit conveyor 8, will now be described.

The motors, 24, 25, 26, 27, 28 can be controlled independently, for example electronically, in order to apply these kinematic laws. Alternatively, suitable transmission mechanisms can be provided, in order to obtain the desired speed dependencies between the various movable parts (one example of this type of mechanism is provided in FR-B-2,234,395).

Referring to FIG. 3, v denotes the delivery speed of the web 4 at the entrance of the stretcher/lapper, u the algebraic speed of the feed carriage 10 and w the algebraic speed of the unwinding carriage 14. The delivery speed v of the web 4 is always counted as positive and algebraic speeds u, w of the carriages 10, 14 are counted as positive in the direction indicated in FIG. 3, in which the carriages 10, 14 are displaced in a direction identical to the direction of delivery of the web 4, and as negative in the opposite direction. The speed v, which is generally constant, is imposed by the output of the card located upstream of the stretcher/lapper. The speed u and w are imparted respectively by the motors 24 and 25.

The motor 26 for the travel of the front transporter 2 is set so as to impart to it a speed equal to the speed v in the sections where it receives the web 4 upstream of the feed carriage 10. The motor 27 for the travel of the rear transporter 5 is set so as to impart to it a speed x (see FIG. 3) equal to $v-2u$ upstream of the feed carriage 10, in such a way that the two transporters 2, 5 have the same speed in the nip zone 23.

Under these conditions, the speed y of unwinding of the web 4 by the unwinding carriage 14 toward the exit conveyor 8 is equal to $x+w=v-2u+w$.

Figure 5:
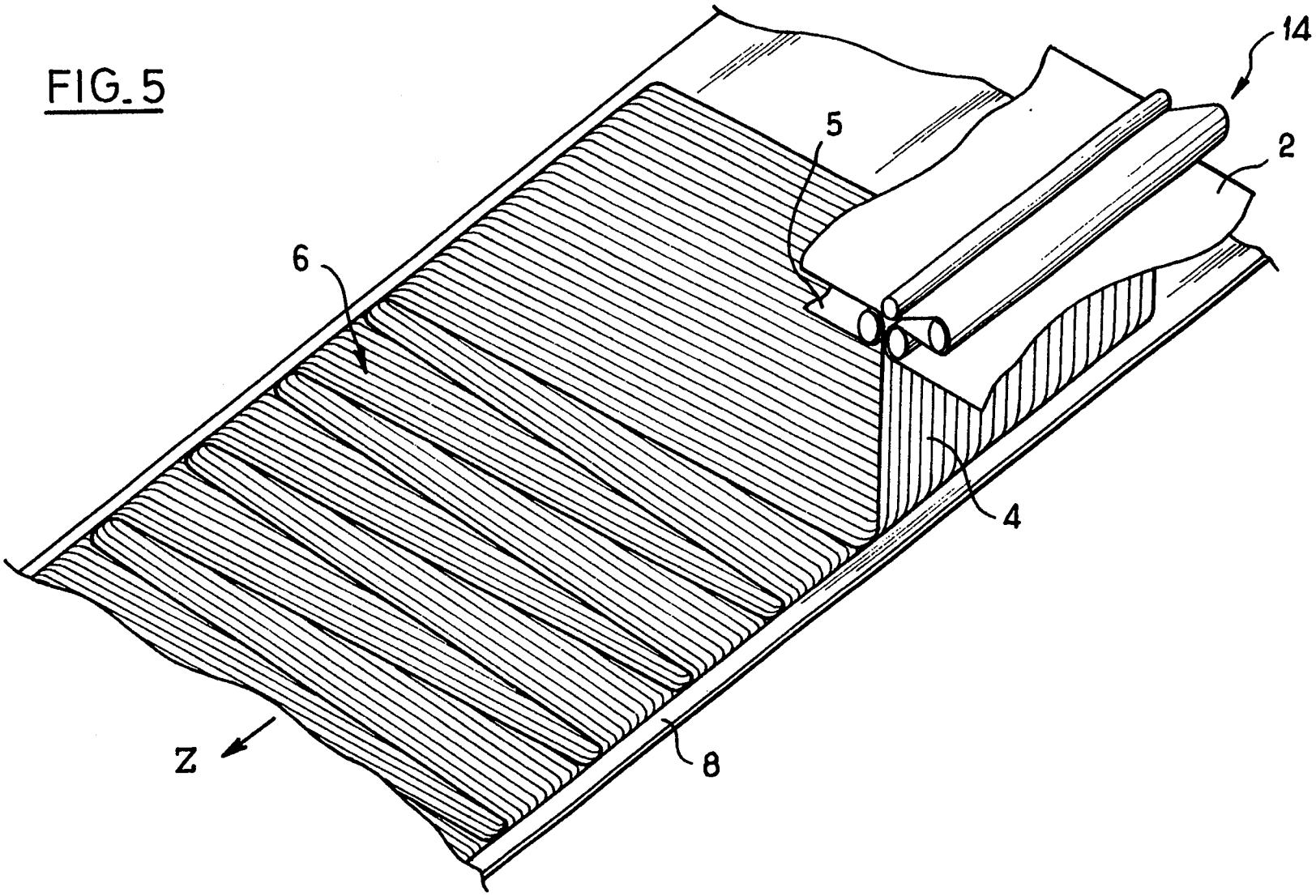
FIG. 5 is a perspective view illustrating the deposition of the web on the exit conveyor of the stretcher/-lapper.

FIG. 5 shows the speed z imparted to the exit conveyor 8 by its drive motor 28.

Figure 4:
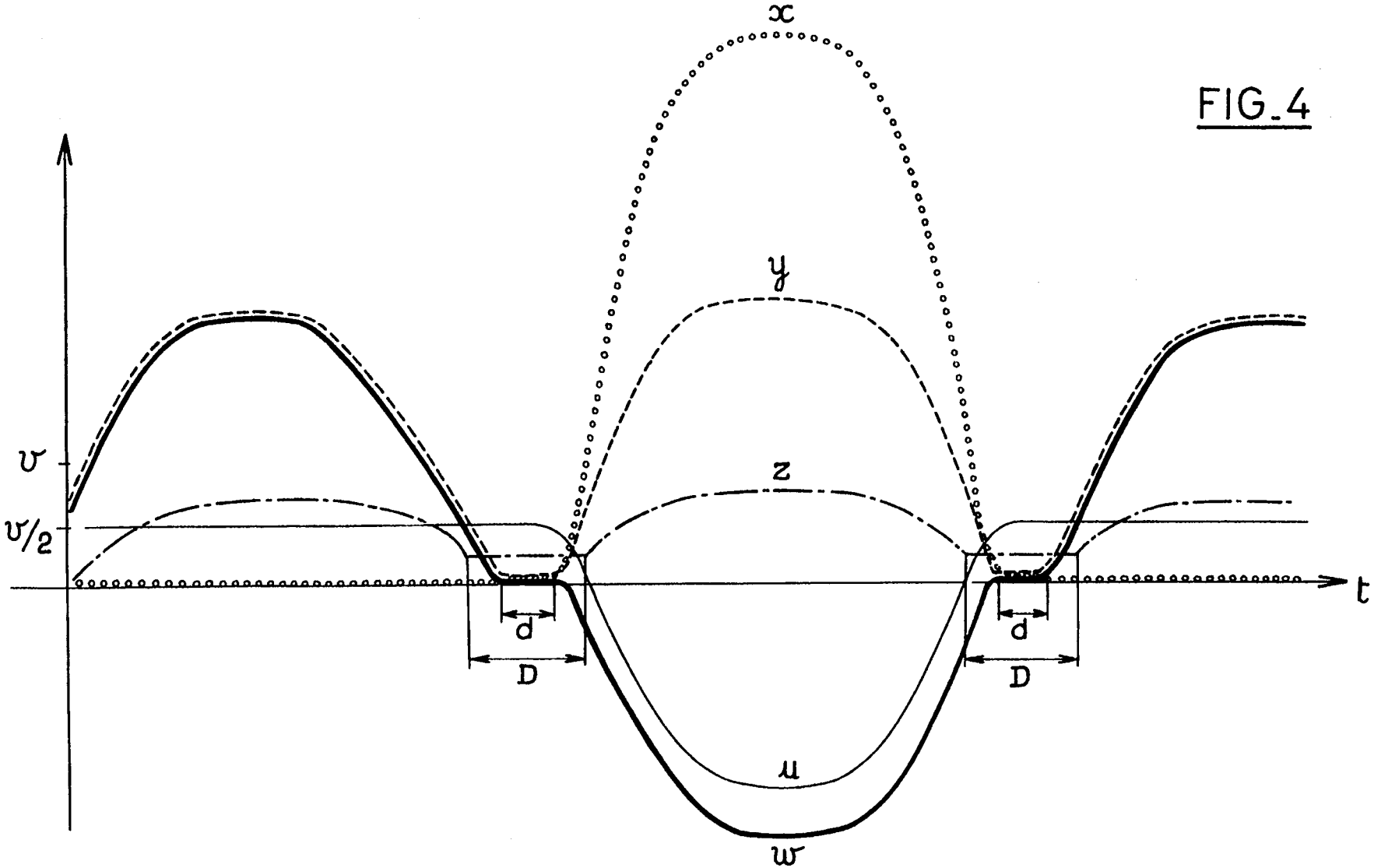
FIG. 4 shows a graph illustrating the instantaneous speeds of various components of the stretcher/lapper.

FIG. 4 shows examples of timing diagrams for the speeds u, w, x and z which can be imparted respectively by the motors 24, 25, 27 and 28 (the constant timing diagram of the speed v imparted by the motor 26 has not been shown). FIG. 4 also shows, by dashes, the timing diagram of the unwinding speed y resulting from the speeds imparted by the various motors.

The speed w of the unwinding carriage 14, represented by a thick line in FIG. 4, obeys a periodic law alternating as a function of the time t, each alternation corresponding to a breadth of the lap 6 formed on the exit conveyor 8. The speed w can, for example, obey a sine law. In the example illustrated, the unwinding carriage 14 has a brief stopping time of duration d at the moment of its change in direction.

The drive motor 24 of the feed carriage 10 is set in such a way that its speed u satisfies the following relations (the curve represented by an unbroken line in FIG. 4):

$$u=w+v/2 \text{ when } w<0$$

$$u=v/2 \text{ when } w\geqq 0$$

The motor 27 is then set so that it drives the rear transporter 5 at a speed $x=v-2u$, the curve of which is drawn in the form of dots in FIG. 4. Under these conditions, the unwinding speed y of the web 4 is equal at each moment to the absolute value of the speed w of translation of the unwinding carriage 14. It will be noted that the unwinding of the web 4 is interrupted ($y=0$) during the stopping times d corresponding to the changes in direction of the unwinding carriage 14.

The motor 28 is set so that the instantaneous speed z of the exit conveyor 8 is proportional to the unwinding speed y of the web 4 and therefore proportional to the absolute value of the speed w of the unwinding carriage, the ratio $a=z/|w|=z/y$ defining the mean angle between the fibers of each breadth of the deposited web and the transverse direction of the lap 6. However, during a short time interval D including each stopping time d of the unwinding carriage 14, the motor 28 imparts to the exit conveyor 8 a non-zero speed z, that is to say a speed which is higher than that which would result from the calculation of proportionality to the speed y according to the ratio a. The advance of the exit conveyor 8 is therefore uninterrupted even at the moments of the changes in direction of the movement of the unwinding carriage 14. In other words, during the time intervals D, the quantity of web 4 unwound by the unwinding carriage 14 toward the exit conveyor 8 in relation to the speed z of the exit conveyor 8 is restricted. Thus, at the moments of the changes in direction of movement of the unwinding carriage 14, a pull is exerted on the fibers between the exit conveyor 8 and the unwinding carriage 14 and tends to orient the fibers which form the folds of the web at the edges of the lap 6 parallel to the longitudinal direction of the exit conveyor 8.

FIG. 5 illustrates diagrammatically the non-woven lapped product 6 obtained on the exit conveyor 8 and shows the unwinding carriage 14 at the moment when it changes direction above one edge of the lap 6. At this moment, the speed z of the exit conveyor 8 is non-zero and the unwinding of the web 4 is restricted or interrupted (y=0). The lateral edges of the lap 6 then comprise portions of fibers oriented substantially longitudinally and forming an obtuse angle with other portions of the same fibers contained in breadths of web inclined and directed obliquely toward the central part of the lap 6.

On account of these portions of fibers oriented longitudinally, the lapped product 6 has a satisfactory longitudinal tensile strength. Furthermore, during a subsequent needling, it will experience an advantageously reduced transverse shrinkage.

Although a specific exemplary embodiment of the present invention has been described, it will be noted that various modifications can be made to it, without departing from the scope of the invention.

Thus, an example, in which the unwinding speed y of the web 4 is at each moment equal to the absolute value of the speed w of displacement of the unwinding carriage 14, has been described. According to the invention, it is generally preferable for this unwinding speed y to be proportional to |w|, the instance of equality described being only one particular example in which the proportionality ratio is 1.

Moreover, it will emerge clearly to a person skilled in the art that the process according to the invention can be carried out with stretcher/lappers different from that described by way of example with reference to FIGS. 1 to 3.

We claim:

1. In a lapping process, in which an unwinding carriage (14) is fed with a length of web (4) having a delivery speed and comprising fibers directed substantially parallel to the length of the web, while the unwinding carriage (14) is displaced in a to-and-fro movement above an advancing exit conveyor (8), so as to deposit the web (4) on the exit conveyor (8) driven in a longitudinal direction which is transverse to the direction of movement of the unwinding carriage (14), so as to produce a lap (6) having edges and consisting of successive breadths of web inclined once in one direction and once in the other in relation to the longitudinal direction of the exit conveyor (8), said breadths being joined by folds defining the edges of the produced lap (6), the improvement which comprises: maintaining the advance of the exit conveyor (8) at the moment of the change in direction of movement of the unwinding carriage (14) during which the speed of the exit conveyor is higher than that of the unwinding carriage, and at said moment, restricting the quantity of web (4) unwound by the unwinding carriage (14) toward the exit conveyor (8), so as to exert on the fibers, between the exit conveyor (8) and the unwinding carriage (14), a pull tending to orient the fibers which form the folds of the web in the lap (6) parallel to the longitudinal direction of the exit conveyor (8).

2. The process as claimed in claim 1, wherein the unwinding of the web (4) by the unwinding carriage (14) is interrupted at the moment of the change in direction of movement of the unwinding carriage (14).

3. The process as claimed in claim 1, wherein the unwinding carriage (14) is fed by a feed carriage (10), and wherein the unwinding and feed carriages (10, 14) are operated at such a speed so as to satisfy the following relations:

the speed (u) of the feed carriage (10) is equal to the algebraic sum of the speed (w) of the unwinding carriage (14) and of half the delivery speed (v) of the web (4) when the unwinding carriage (14) is displaced in the direction opposite to the delivery direction of the web (4), and the speed (u) of the feed carriage (10) is equal to half the delivery speed (v) of the web (4) when the unwinding carriage (14) is displaced in the direction identical to the delivery direction of the web (4), in which relations the delivery speed (v) of the web (4) is always counted as positive and the speeds (u, w) of the unwinding and feed carriages (10, 14) are counted as positive in the direction in which said carriages are displaced in the direction identical to the delivery direction of the web, and as negative in the opposite direction.

4. The process as claimed in claim 3, wherein exit conveyor (8) is displaced at a speed (z) which is proportional to the absolute value of the speed (w) of the unwinding carriage (14) at any moment, except within time intervals (D) including the moments of change in direction of movement of the unwinding carriage (14), during which the exit conveyor (8) is displaced at a speed which is higher than that which would result from a calculation of proportionality in relation to the absolute value of the speed of the unwinding carriage (14).

5. The process as claimed in claim 4, wherein the web (4) is unwound by the unwinding carriage (14) at a speed (y) which is proportional to the speed (z) of the exit conveyor (8), except within time intervals (D) including the changes in direction of movement of the unwinding carriage (14), during which the unwinding speed (y) is lower than that which result from a calculation of proportionality in relation to the speed (z) of the exit conveyor (8).

6. The process as claimed in claim 5, wherein the speed (y) of unwinding of the web (4) by the unwinding carriage (14) is at each moment substantially proportional to the absolute value of the speed (w) of displacement of the unwinding carriage (14).

7. A nonwoven lapped product produced by the process of claim 1.

8. A lapping machine, comprising an unwinding carriage (14) fed with a length of web (4) having fibers directed substantially parallel to the length of the web, means for displacing said unwinding carriage (14) with a to-and-fro movement above an advancing exit conveyor (8), so as to cause the unwinding carriage (14) to deposit the web (4) on the exit conveyor (8), means for driving the exit conveyor in a longitudinal direction transverse to the direction of movement of the unwinding carriage (14), so as to produce a lap (6) having edges and consisting of successive breadths of web inclined once in one direction and once in the other in relation to the longitudinal direction of the exit conveyor (8), said breadths being joined by means of folds defining the edges of the lap produced (6), means for maintaining the advance of the exit conveyor (8) at the moment of change in direction of movement of the unwinding carriage (14) during which the speed of the exit conveyor is higher than that of the unwinding carriage, and at said moment, means for restricting the quantity of web (4) unwound by the unwinding carriage (14) toward the exit conveyor (8), so as to exert on the fibers, between the exit conveyor (8) and the unwinding carriage (14), a pull tending to orient the fibers which form the folds of the web in the lap (6) parallel to the longitudinal direction of the exit conveyor (8).

9. The lapping machine as claimed in claim 8, further including means for unwinding the web at a speed (y) proportional to the absolute value of the speed (w) of the unwinding carriage (14).

10. The lapping machine as claimed in claim 8, further comprising a movable feed carriage (10) for feeding web to the unwinding carriage (14), and means (24, 25) for driving the feed carriage (10) and the unwinding carriage (14) at such speeds so as to satisfy the following relations:

the speed (u) of the feed carriage (10) is equal to the algebraic sum of the speed (w) of the unwinding carriage (14) and of half the delivery speed (v) of the web (4) when the unwinding carriage (14) is displaced in the direction opposite to the delivery direction of the web (4), and the speed (u) of the feed carriage (10) is equal to half the delivery speed (v) of the web (4) when the unwinding carriage (14) is displaced in the direction identical to the direction of delivery of the web (4), in which relations the delivery speed (v) of the web (4) is always counted as positive and the speeds (u, w) of the carriages (10, 14) are counted as positive in the direction in which said carriages are displaced in the direction identical to the delivery direction of the web, and as negative in the opposite direction.

* * * * *